United States Patent [19]

Cox

[11] Patent Number: 4,758,000

[45] Date of Patent: Jul. 19, 1988

[54] GAMES STROKE PRACTICING APPARATUS

[75] Inventor: Robert W. Cox, Chapel Hill, Australia

[73] Assignee: Kenmore Squash Centre Pty. Ltd., Queensland, Australia

[21] Appl. No.: 6,807

[22] Filed: Jan. 27, 1987

Related U.S. Application Data

[63] Continuation-in-part of Ser. No. 717,236, Mar. 20, 1985, abandoned.

[30] Foreign Application Priority Data

| | | | |
|---|---|---|---|
| Jul. 21, 1983 | [AU] | Australia | PG0395 |
| Dec. 20, 1983 | [AU] | Australia | PG2916 |
| Jul. 16, 1984 | [WO] | PCT Int'l Appl. | PCT/AU84/00138 |
| Mar. 10, 1986 | [AU] | Australia | PH04955 |
| Oct. 27, 1986 | [AU] | Australia | PH08710 |

[51] Int. Cl.[4] ..... A63B 69/36

[52] U.S. Cl. ..... 273/190 R; 273/191 A; 273/187 A; 273/191 B; 273/186 R

[58] Field of Search ..... 273/186 R, 187 R, 187 A, 273/188 R, 189 R, 189 A, 190 R, 190 A, 190 B, 191 R, 191 A, 191 B, 183 B, 192; 434/252

[56] References Cited

U.S. PATENT DOCUMENTS

| | | | |
|---|---|---|---|
| 1,530,519 | 3/1925 | Remington | 273/188 R |
| 2,690,911 | 10/1954 | Newgren | 273/190 R |
| 2,737,432 | 3/1956 | Jenks | 273/191 R |
| 3,397,892 | 8/1968 | Stahl | 273/190 R |
| 3,876,212 | 4/1975 | Oppenheimer | 273/190 R |
| 4,318,546 | 3/1982 | Chen | 273/188 R |
| 4,326,718 | 4/1982 | Kiehl | 273/190 R |

FOREIGN PATENT DOCUMENTS

| | | | |
|---|---|---|---|
| 932757 | 8/1973 | Canada | 273/188 R |
| 27103 | of 1910 | United Kingdom | 273/188 R |

*Primary Examiner*—George J. Marlo
*Attorney, Agent, or Firm*—Murray and Whisenhunt

[57] ABSTRACT

Practice apparatus for positioning a user in a golf stance and for guiding the user's body through a golf stroke. The apparatus includes a support for supporting an elevated crank arm assembly for pivotal movement about a golf stroke swing axis located by the support to pass through the upper body, neck and head of a user in a golf swing stance and substantially within the plane of symmetry of the user's upper body. The crank arm assembly has an offset portion spaced above the swing axis, and a pivot mounting is provided on the offset portion. A shoulder guide is mounted on the pivot mounting for pivotal movement relative to the offset portion about a shoulder guide pivot axis which intersects and is inclined to the swing axis. The shoulder guide extends beneath the offset portion for engagement with the shoulders of a user disposed in a golf swing stance.

14 Claims, 6 Drawing Sheets

GAMES STROKE PRACTICING APPARATUS

CROSS-REFERENCE TO RELATED APPLICATIONS

The present application is a continuation-in-part of application Ser. No. 717,236, filed Nov. 20, 1985 now abandoned.

This invention relates to golf stroke practising apparatus.

In the past many devices have been provided for practising golf. The general aim of such devices is to enable a player to perfect the stance for addressing the ball and the swing. It is generally considered that the correct swing is performed in a plane called the swing plane and to date all sorts of rules for stance and body alignment have been formulated to enable a golfer to achieve the correct swing. For example those who have become successful golfers have attempted to define arbitary rules by reference to their own body positions and feelings.

During a game of golf many different strokes are performed, often under less than ideal conditions and of course the greater the number of variables, the less the chance of performing consistently. It follows that if a constant swing can be mastered and used for all strokes, the number of variables are greatly reduced and more consistent results can be obtained. Different strokes may be played according to the situation by selecting the correct ball position relative to the player, i.e., to be hit upon the down stroke, at the bottom of the swing or on the up stroke, the correct club and the correct angle of the striking face of the club relative to the swing plane. This angle may be selectively varied to produce inswingers or outswingers.

A typical prior art device used for guiding players included a circular guide for a club head which is adapted to be positioned in the swing plane so that a golfer could practice swinging in the correct plane. However to achieve the correct club movement the player could make all sorts of body compensations and thus the player would not necessarily practice a correct swing. Furthermore as the club was supported by the apparatus the feel during practice was not the same as when playing.

Many people have realised this deficiency and various types of swing guide devices have been provided for controlling the player's swing. Some of these devices have been relatively simple, such as the Logan device illustrated in British Patent No. 27,103 while some have been extremely complicated such as the Jenks device illustrated in U.S. Pat. No. 2,737,432.

A difficulty encountered with swing guide device is in.

One of the reasons for this may be the difficulty in controlling the body for the golf swing movement as such body movement is complex and past devices have tended to apply body controls adapted to simulate the perceived ideal club movement as opposed to the ideal body movement. In this respect, in devices on which a shoulder support has been incorporated the arrangement has been to provide for a simple body pivot action whereby the shoulders rotate within the one plane.

There have been many articles published in instruction books and magazines by noted professionals and teachers describing such shoulder action as "turning in the same plane as the club head swing plane" or "turning in a flatter plane than the club swing plane", or "turning in a plane parallel to the hip turn plane." Other descriptions have been "turning in a plane at right angles to the spine" or simply "turning around the spine" and prior art devices were arranged to control the body for this single plane action of the shoulders.

For example, Remingtons invention, U.S. Pat. No. 1,530,519 incorporates and describes a horizontal swing plane for the shoulders. Chen's invention, U.S. Pat. No. 4,318,546, provides a shoulder swing plane at right angles to the spine and Logan's British Pat. No. 27,103 provides the shoulder swing plane at right angles to an imaginary swing axis passing through the body from the crown of the head to the lower part of the body.

This invention aims to alleviate the disadvantages associated with such prior art devices and to provide practising apparatus which will be reliable and efficient in use. Other objects and advantages of this invention will hereinafter become apparent.

SUMMARY OF THE INVENTION

With the foregoing and other objects in view, this invention in one aspect resides broadly in apparatus for practising golf strokes, including:- support means supporting an elevated crank arm assembly for pivotal movement about an inclined swing axis and body location means for guiding a users upper body movement relative to said swing axis whereby a user may assume a golf swing stance with their upper body engaged with said body location means and intersected by said swing axis, said body location means including a shoulder support which is pivotally mounted on the offset portion of said crank arm and arranged to pivot about a shoulder pivot axis inclined to said swing axis.

The support means may be height adjustable to suit different players and it may include an adjustable mounting for the crank arm whereby the latter can be supported at various inclinations. In this respect it will be appreciated that in the game of golf, the inclination of the swing plane varies with the length of the various clubs used such that a golfer stands more upright when driving compared to putting using a relatively short club.

The body location means may include a shoulder support and head location means adapted to locate the head in line with the swing axis. Alternatively the body location means may include a shoulder support and an integral lower body guide. The shoulder pivot axis may be disposed at any suitable angle to the swing plane, depending on the stroke to be performed and if desired the shoulder support may be universally mounted. The shoulder support may be adapted to pivot freely about its mounting on the inclined crank arm or it may pivot in a controlled manner relative to pivotal movement of the crank arm about the pivot axis.

In a further aspect of this invention the shoulder support means is supported by a universal joint so that it can pivot and rotate freely to follow the player's movements and sensing means are provided to monitor the movements. The universal joint may be provided with locking means to enable the practising apparatus to be used as described above, or after a player has gained confidence in their stance and swing the player may unlock the universal joint and other constraints, switch on the monitoring apparatus and play some strokes. The apparatus will not guide the player but the monitoring apparatus will show variations from the ideal stroke. Thus a player may use the apparatus to correct faults in play. The monitoring apparatus may be electronic or mechanical as appropriate.

BRIEF DESCRIPTION OF THE DRAWINGS

In order that the present invention may be more readily understood and put into practical effect, reference will now be made to the accompanying drawings which illustrate preferred embodiments of the invention, wherein.

DETAILED DESCRIPTION OF THE INVENTION

Figure 1:
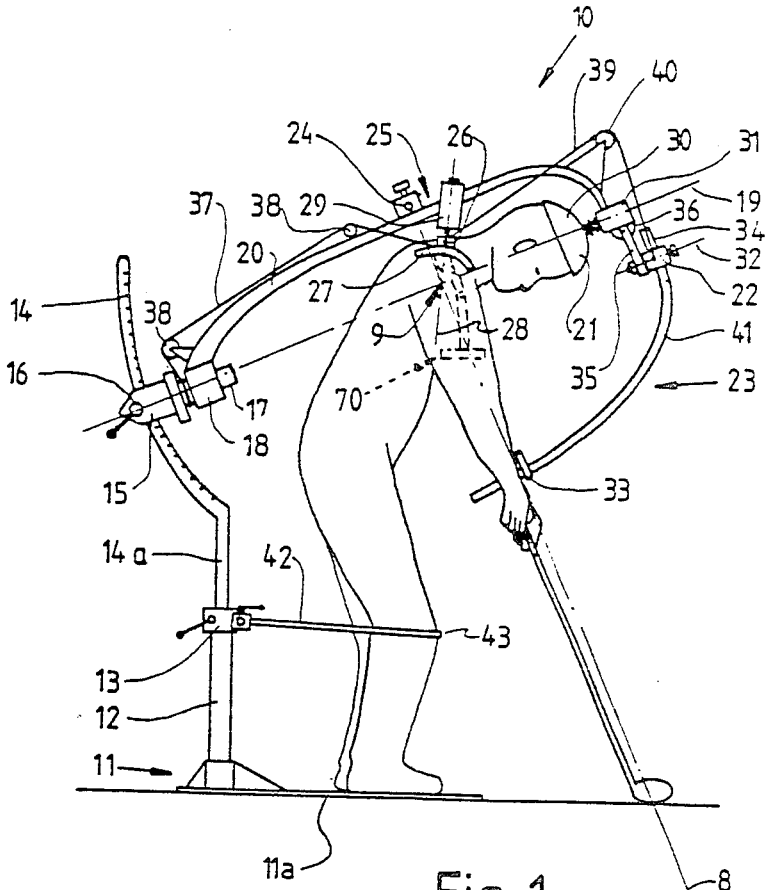
FIG. 1 is a side view of a preferred form of practising apparatus made according to one aspect of the present invention.

Referring to FIGS. 1 to 4 it will be seen that the practising apparatus 10 comprises a base stand assembly 11 including a base board 11*a* upon which a player can stand and which supports a verical post 12. The latter has clamping means 13 at its upper end for adjustably securing a mounting stem 14*a* which engages telescopically in the post 12 and supports an adjustable bearing mount 15. The bearing mount 15 is slidable along the guide rail 14 and it is provided with lever operated eccentric clamping means 16 for securing the mount 15 in any selected position along the curved guide rail 14 such that the inclination of the bearing mount 15 may be varied. This inclination may be read directly from the scale marked on the guide rail 14.

The bearing mount 15 supports a stub axle 17 on which a hub 18 is supported by suitable bearings. The hub 18 supports a crank arm 20 which extends away from the rail 14 to support a head cap locator 21 and an adjustable pivotal mounting 22 for a hand guide assembly 23. The arm 20 also provides an intermediate mounting for a fixed club guide bar 24 substantially in the swing plane 8 and a pivotal mounting for the shoulder yoke 25.

The centre of curvature of the guide rail 14 is at a point 9 on the swing axis 19 which is substantially at shoulder height such that the height of this point does not vary with adjustments in the inclination of the bearing mount 15. If desired the guide rail 14 could be provided with a rack engaged by a hand wheel operated pinion on the mount 15 whereby the hand wheel could be rotated to move the mount 15 along the rail 14. The shoulder yoke 25 includes a cross bar 26 having curved shoulder straps 27 at each end and adapted to rest about a player's shoulder. It will be seen that the hand guide assembly 23 maintains the hands in a swing plane 8 disposed at right angles to the pivot axis 19 and that the axis 28 of the shoulder yoke pivot mounting 29 intersects the axis 19 at the point 9 which is adjacent the point of intersection between the inclined swing axis 19 and the swing plane 8. The head locator 21 includes a cap portion 30 which is mounted on the hub 31 for reciprocation along the axis 19 against a spring bias to provide adjustment for different players.

The hand guide assembly 23 is pivotable about an axis 32 spaced from but parallel to the axis 19 whereby the hand abutment bar 33 carried at the free end of the guide 23 will pivot in the swing plane 8. The guide 23 includes a top mounting portion 34 which may move through the releasable mounting 29 for adjustment to suit various players arm lengths. Also if desired the supporting member 35 may be pivotally secured at 36 to the hub 31 whereby the angle of the swing plane, in which the hand guide assembly 23 moves, relative to the inclined axis 19 may be selectively varied to non-parallel positions with respect to the axis 19.

The shoulder yoke 25 may be connected by a pair of cables 37 extending from a respective side of the yoke 25 about guide pulleys 38 to a fixed point on the mounting 15 such that pivotal movement of the arm 10 about the stub axle 17 will cause the shoulder yoke 25 to pivot. A further pair of cables 39 may pass from opposite sides of the yoke 25 about pulleys 40 to the mounting 22 from the guide 23 whereby pivotal movement of the yoke 25 relative to the arm 20 will cause the hand guide 23 to pivot about its support axis 32. It will be seen that the central bar 41 of the hand guide assembly extends beyond the curved cross bar 33 to provide a stop against which the player's hands may be restrained.

During initial practice, the cables 37 are connected to the yoke 25 in order to provide a positive guide to the pivotal co-ordination between movement of the shoulders and the body. At the same time the cables 39 cause the hand guide assembly 23 to move in co-ordination with the shoulder yoke 25. This arrangement causes the yoke 25 to pivot about its inclined axis 28 in controlled manner as the player's upper body portion swivels between the back swing position and the follow through position, causing the arm 20 to pivot about its support axis to opposite sides of the central position illustrated FIG. 1.

If desired the device can be used effectively without either or both sets of cables secured. Additionally the distance of the points of connection of the cables on the shoulder yoke 25 may be varied to achieve the desired relative pivotal movements between the arm 20 about the inclined axis 19, the pivoting of the shoulder yoke 25 and the pivoting of the hand guide assembly 23. The abutment bar 33 may be adapted for attachment of removable extension pieces thereto. Because the abutment bar 33 moves in the swing plane, such extension pieces could be adapted to extend into the path of the club head to provide a further indication or guide for performing the stroke in the swing plane. The extension pieces could be of any desired shape or form to provide coincidence with the club head or shaft at desired stations along the club swing path. The extension pieces could be fitted to either end of the abutment bar 33. Such extension pieces could be used for example, for slow motion training.

The practising apparatus 10 also provides a leg guide bar 42 having a hooked outer end portion 43 which extends about the appropriate leg to ensure the correct stance, as illustrated. The bar 42 may be supported adjustably at either side of the post 12 for use by left or right hand players. As will be seen in FIGS. 2 to 4 the cross bar 24 provides a guide or stop for the club shaft in the backswing and follow-through positions.

In use, adjustment of the bearing mount 15 along the guide rail 14 will vary the inclination of the swing plane but it will not vary the height of the point of intersection 9 of the axes 19 and 28 which will remain a fixed position reference for the player's body. Of course the radius of the guide rail 14 may be varied from that illustrated. For example the radius of the rail or the form of its curve may be arranged whereby the shoulder yoke 25 is elevated as the apparatus is adjusted for use with longer clubs.

Figure 2:
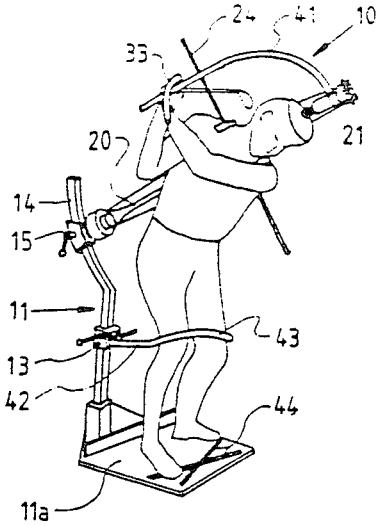
FIG. 2 is a corresponding view illustrating the apparatus with the player in the backswing position.
Figure 3:
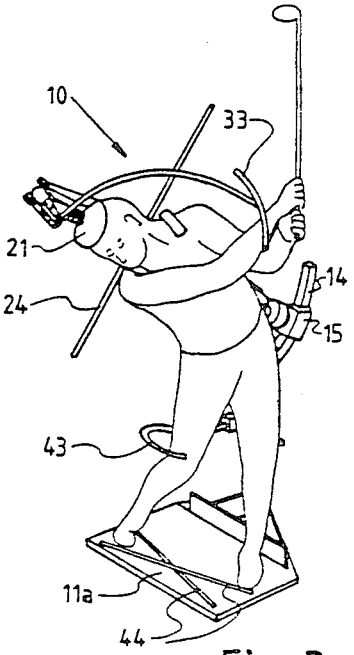
FIG. 3 is a view of the apparatus from the opposite side and illustrated with the player in the follow through position.
Figure 4:
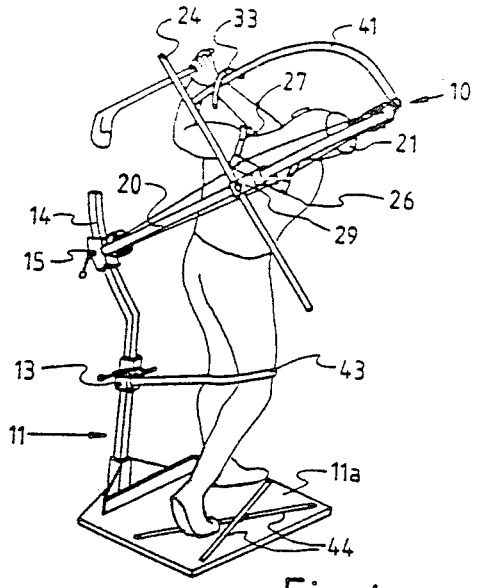
FIG. 4 is a rear view of the apparatus with the player in the follow through position.

When practising, the player first adopts a stance position as illustrated in FIG. 1. The player then pivots to the backswing position as shown in FIG. 2 with the hands held against the hand abutment bar 33 and the extension of the central bar 41 and with the club shaft abutting the club guide bar 24. The player then performs a stroke whereby the club pivots to the opposite portion of the club guide bar 24. During this action the upper body portion is restrained for pivotal movement about the swing plane axis 19, the shoulders pivot about a fixed axis 28 relative to the swing plane axis 19 and the hands move in the swing plane 8. Accordingly it will be seen that the players hands and shoulders are controlled for movement about a fixed swing axis 19 and by practising strokes guided by the apparatus 10 a player will learn to swing accurately in a controlled manner about a single swing axis such that the player may concentrate on placement of the ball, club choice and angle of strike to achieve the desired stroke.

If desired the base board 11*a* may provide indications 44 for feet placement, so that the player's feet are correctly placed relative to the ball target. The device can be used with a target ball such as a squash ball or without a target ball if desired. The latter could be associated with sensing apparatus to provide an indication of the distance and/or direction of the probable ball motion resulting from a practice stroke. The shoulder yoke assembly 25 could be interconnected with either or both the bearing mount 15 and the hand guide assembly by suitable mechanical linkages or with gear linkages in lieu of the cable linkages illustrated.

Figure 5:
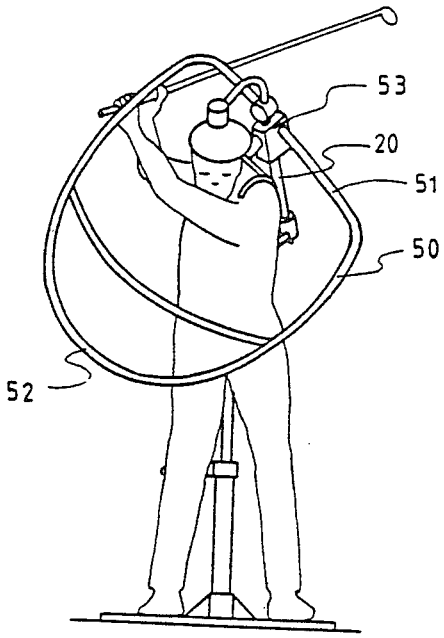
FIG. 5 is a front view of an alternate form of the invention.

Referring to FIG. 5 it will be seen that the apparatus is generally similar to the previously described embodiment except that the swing plane guide assembly 50 comprises a rigid frame having a top rail 51 fixed to the pivot arm 20 and which acts as a club shaft guide bar, and a curved guide rail 52 integral with the rail 51 and along which the player's hands may move for guided movement in the swing plane. For this purpose the mounting 53 for securing the rail 51 to the pivot arm 20 is adjustable for pivotal movement about the rail 51 whereby the inclination of the swing plane relative to the upper body pivot axis 19 may be varied as well as for movement along the arm 20. An intermediate rail 54 is provided for forearm guidance. In use, the player's hands move in abutting relationship along the curved rail 52 for motion in the swing plane.

The practising apparatus described in the above embodiments may be used for right and left hand golfers. In order to convert the apparatus illustrated in FIGS. 1 to 5 for left hand practice the leg guide is swapped to the opposite side of the stem so as to hold the left leg in the correct attitude. The leg bar 42 is fully adjustable as illustrated.

Figure 6:
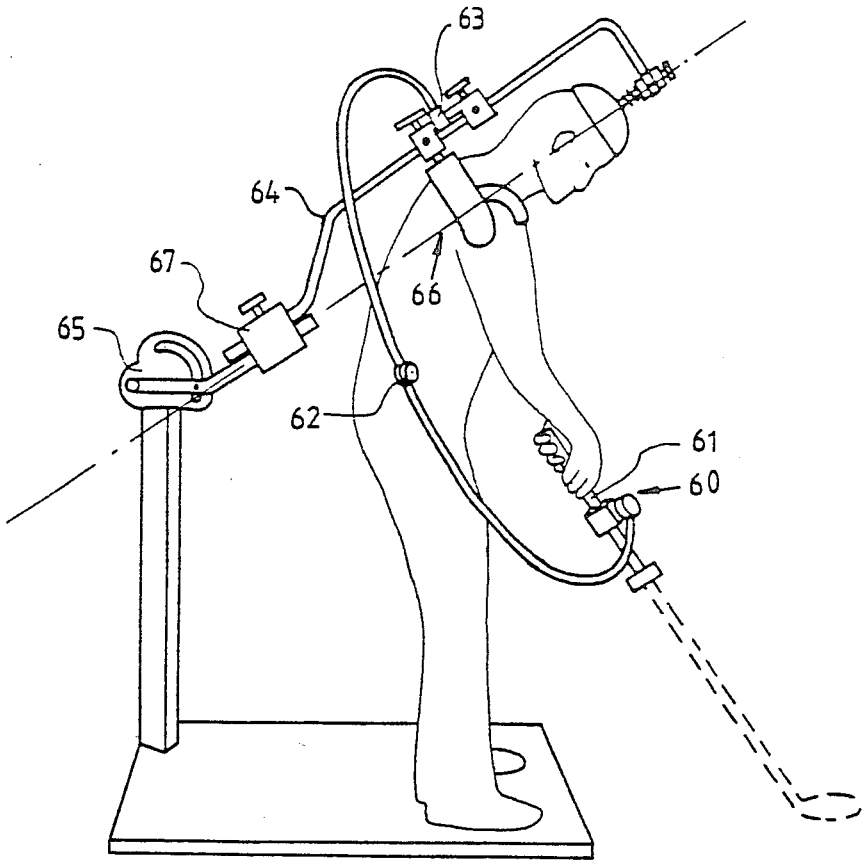
FIG. 6 illustrates a further embodiment of the invention.

In both the above described embodiments the club is held freely by the player. However in the embodiment illustrated in FIG. 6, the swing plane guide assembly 60 supports a golf club handle simulator 61 for movement in the desired swing plane. This is achieved by forming the guide assembly 60 in two parts which are pivotally connected together at 62. One end of the assembly 60 connects pivotally at 63 to the inclined arm 64 while the opposite end connects pivotally to the handle 61. These pivotal connections are arranged for pivotal movement about parallel axes whereby the handle 61 is restrained for movement in the desired swing plane. Furthermore it will be seen that the inclined arm 64 is supported fixedly by an adjustable pivot mounting 65 and that the shoulder yoke assembly 66 and the head locator can pivot about an axes parallel to the pivot axes of the swing plane guide assembly. Height adjustment of the shoulder yoke 66 is adjustable independently of the pivot mounting 65 by relative movement of the two part adjustor 67 mounted between the pivot mounting 65 and the yoke 66.

Figure 7:
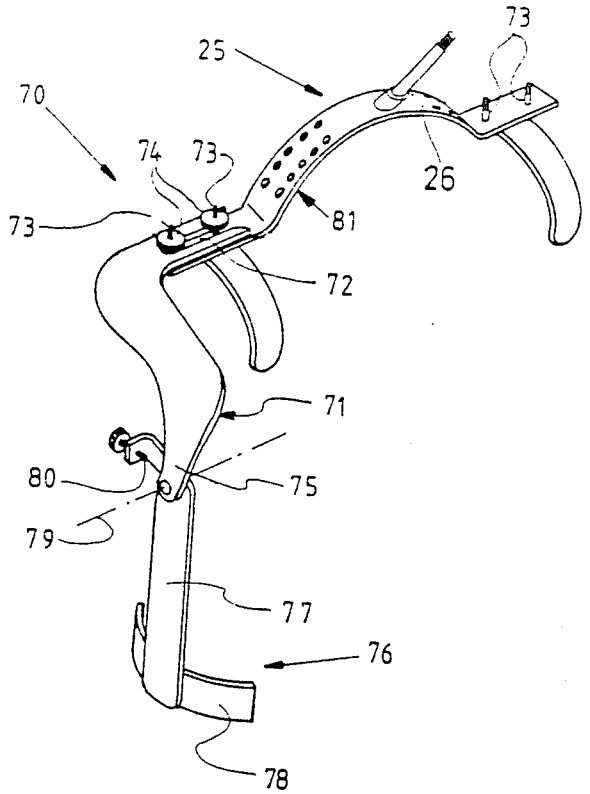
FIG. 7 is a perspective view illustrating an arm restraint mechanism for use with the various embodiments of this invention.

FIG. 7 illustrates an arm restraint assembly 70 which may be attached to either side of the shoulder yoke 25, as shown in dotted outline in FIG. 1, for movement therewith and adapted to prevent lifting of the elbow of the rear arm when the latter is moved to the backswing position and to guide movement of the arm through the stroke. For this purpose the restraint assembly includes a slotted mounting bracket 71 which may be secured to the cross bar 16 by engagement of the slot 72 about the studs 73 fixed to the cross bar 26. The bracket 71 may be clamped in the selected position by tightening the finger nuts 74 when the bracket 71 is positioned to suit the user. The bracket 71 includes an arm 75 which is cracked forwardly and downwardly to provide a pivotal mounting for the guide assembly 76.

As illustrated, the guide assembly 76 includes a central support strut 77 and a curved arm saddle 78 which in use engages about the upper portion of the player's arm. The guide assembly 76 is pivotable about the axis 79 which extends parallel to the shoulders whereby in use the upper arm portion including the elbow is restrained for movement in a plane at right angles to the shoulders. The upper end of the support strut 77 is provided with an adjustable stop 80 adapted to limit rearward movement of the guide assembly 76. If desired a counterweight may be fitted to the opposite end of the shoulder yoke 25 to balance the weight of the restraint assembly 70. The apertures 81 in the cross bar 26 provide alternate mountings for the cables 37 and 39 whereby the relative pivotal movement between the support stand, the shoulder yoke 25 and the hand guide assembly 23 may be varied to suit individual requirements.

Figure 8:
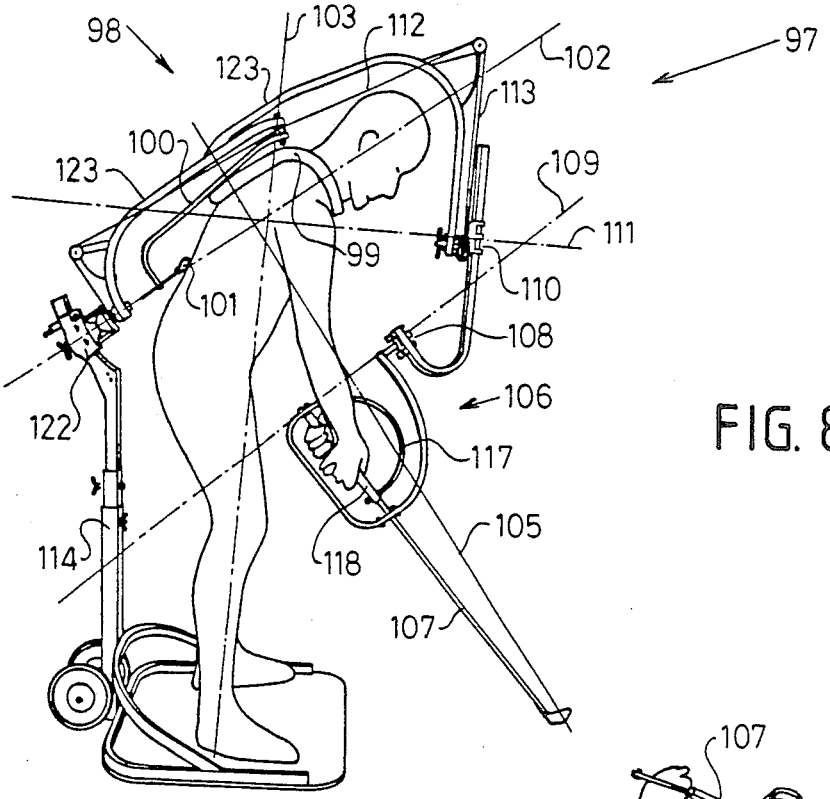
FIG. 8 is a side view of a further embodiment of the invention.
Figure 9:
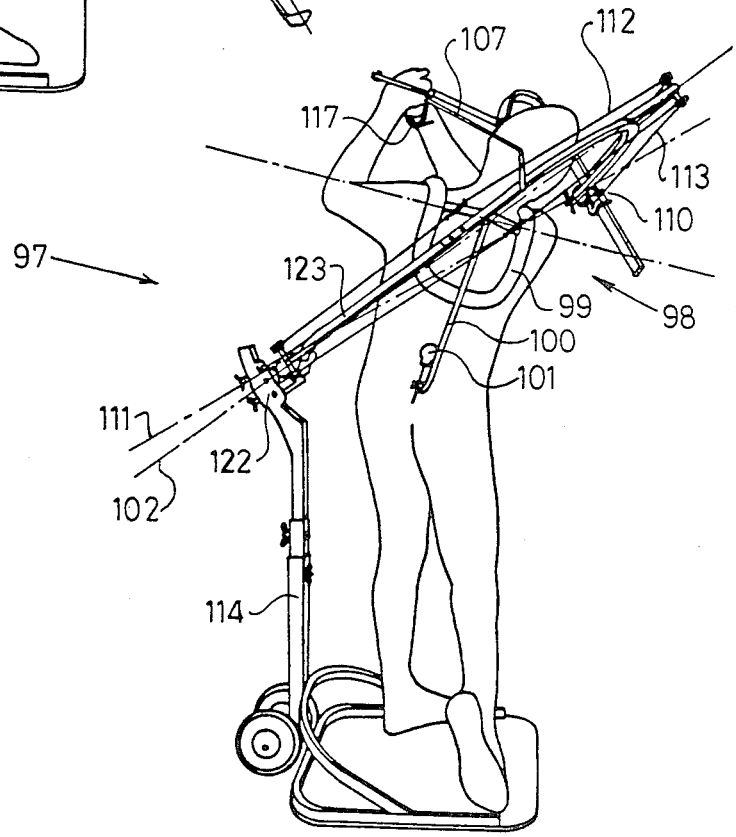
FIG. 9 illustrates the embodiment of FIG. 8 in the back swing position.

The golf swing practice device 97 illustrated in FIGS 8 and 9 is similar to that illustrated in FIGS. 1 to 4. However it does not utilize a head guide or a leg guide. In lieu of these the upper body support 98 includes a shoulder yoke 99 provided with a fixed downwardly extending arm 100 which terminates adjacent the lower spine and supports an abutment knob 101. In use the user endeavours to maintain the knob 101 in contact with the lower spine so as to control the upper body for the selected movement. As can be seen in FIG 8, when the practice device 97 is in the mid-swing position the swing axis 102 passes through the base of the spine and the neck and head of the user while the shoulder pivot axis 103 passes adjacent the intersection of the swing axis 102 with the swing plane 105.

The device 97 also utilizes a linkage 106 having a pair of spaced pivots for controlling movement of a golf club 107. These pivots include a lower wrist pivot 108 which supports the club 107 for pivotal movement about an inclined wrist pivot axis 109 which extends substantially parallel to the swing axis 102 and an intermediate pivot 110 which supports the club 107 for pivotal movement about an intermediate axis 111. The latter passes through or adjacent the intersection of the swing axis 102 with the swing plane 105. This arrangement enables a user to swing with the hands spaced rearwardly of the swing plane so as to free the wrists for comfortable and controlled pivotal movement throughout the swing.

Figure 10:
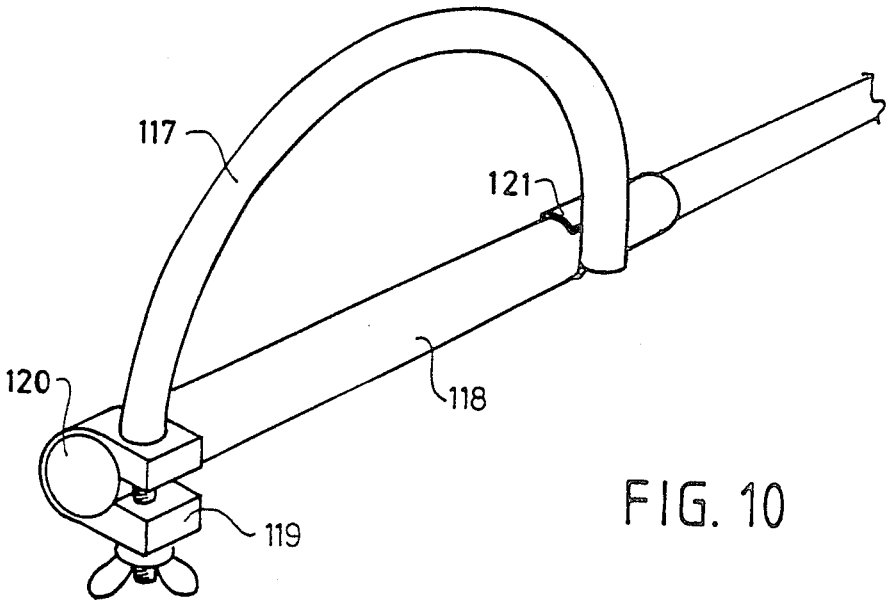
FIG. 10 illustrates a club shaft attachment.

The pivot control cables 112 and 113 which connect the shoulder yoke 99 to the stand 114 and the shoulder yoke 99 to the golf club support linkage 106 operate as for the previous embodiment. However the cables 113 which control pivotal movement of the linkage 106 about the intermediate pivot 110 do not extend beyond the intermediate link 116 between the wrist pivot 108 and the intermediate pivot 110. The wrist pivot 108 is controlled by the user maintaining contact between the inner portion of the trailing arm and the arcuate guide bar 117 fixed about the handle 118 of the club 107. The guide bar 117 as shown in FIG. 10 is semi-circular and is centred on the user's lower wrist. It is provided with a releasable clamp 119 at its outer end whereby it may be rigidly secured to the top end 120 of the club handle. A spring mounting clip 121 is fitted to the lower end of the guide bar 117 to secure it in place.

In use the guide bar 117 is maintained in contact with the trailing forearm to maintain the golf club 107 in a fixed relationship with the arm. This is particularly important in the backswing position as uncontrolled pivoting of the wrist will impart a further pivotal movement to the golf club 107 and move the club head away from the desired swing plane. This undesirable movement of the club head is generally known by the faults "laying off" or "crossing the line". When the club 107 is held in either of these incorrect positions the player must correct the pivotal attitude of the club during the downstroke so that when the ball is struck the club shaft and head will be in their correct striking position in relation to the trailing forearm. The guide bar 117 may be used independently as a coaching aid if desired.

The arcuate guide rail 122 on which the crank arm 123 is supported is centred on the abutment knob 103. Thus for the same range of pivotal movement as in the previous embodiment its overall length can be reduced. This geometry also enables the player's shoulders to lift and fall with changes of pivotal adjustment of the crank arm 123. However it controls the user so that the central portion of the lower back remains substantially the same height irrespective of the inclination of the crank arm 123.

The practising apparatus described above may also incorporate guide means for the lower body portion. This could be in the form of a hip yoke or rest mounted for adjustment to suit various players and pivotable about both horizontal and vertical axes so that the hip yoke is guided for the desired movement. The pivotal mountings for the hip yoke may be formed by linkages to enable preselected movement, other than circular, to be achieved by the hip yoke. Such pivot assemblies could also be used elsewhere in the apparatus to achieve any desired guiding motion. In a simple form the hip yoke could be supported for pivotal movement about a horizontal axis at the upper end of an arm pivotally secured to the base for movement about an upwardly extending axis.

The practising apparatus may also be used to assist golfers to determine correct club lengths when purchasing new clubs since the club lengths may be arranged so as to maintain the stance dictated by the practising apparatus.

It will of course be understood that the above has been given only by way of illustrative example of the present invention and that all such modifications and variations thereto as would be apparent to persons skilled in the art are deemed to fall within the broad scope and ambit of the invention as is defined in the appended claims.

I claim:

1. Practice apparatus for positioning a user in a golf stance and for guiding the user's body through a golf stroke, said practice apparatus comprising:

support means supporting an elevated crank arm assembly for pivotal movement about a golf stroke swing axis (19) located by said support means to pass through the upper body, neck and head of a user in a golf swing stance and substantially within the plane of symmetry of the user's upper body and said crank arm assembly having an offset portion spaced above said swing axis;

a pivot mounting on said offset portion;

a shoulder guide mounted on said pivot mounting for pivotal movement relative to said offset portion about a shoulder guide pivot axis (28) which intersects and is inclined to said swing axis; and said shoulder guide extending beneath said offset portion for engagement with the shoulders of a user disposed in a golf swing stance.

2. Practice apparatus according to claim 1, wherein said support means, said crank arm assembly and said shoulder guide are interconnected by a linkage whereby said shoulder guide is constrained to pivot about said shoulder guide pivot axis as said crank arm assembly pivots about said golf stroke swing axis.

3. Practice apparatus according to claim 2, wherein said linkage includes a pair of cables fixed to said support means and to said shoulder guide at respective positions spaced from said shoulder guide pivot axis and at opposite sides thereof.

4. Practice apparatus according to claim 2, wherein there is provided a lower body abutment formed integrally with said shoulder guide and disposed to engage with a user's lower spine.

5. Practice apparatus according to claim 4, wherein said shoulder guide pivot axis intersects with said golf stroke swing axis adjacent the center of a user's golf stroke swing plane.

6. Practice apparatus according to claim 2, wherein there is provided a hand guide assembly connected pivotally to said crank arm assembly and extending downwardly therefrom to guide a player's hand for movement in a selected motion about said golf stroke swing axis.

7. Practice apparatus according to claim 6, wherein said hand guide assembly is linked to said shoulder guide whereby said hand guide assembly is controlled for pivotal movement relative to pivotal movement of said shoulder guide.

8. Practice apparatus according to claim 6, wherein said hand guide assembly includes a club shaft support for supporting a golf club shaft.

9. Practice apparatus according to claim 8, wherein said club shaft support is detachably securable to a golf club.

10. Practice apparatus according to claim 8, wherein said crank arm assembly extends forwardly beyond the head position of a user and downwardly beyond said golf stroke swing axis to provide a gimbal mounting intermediate said club shaft support and said golf stroke swing axis for said hand guide assembly.

11. Practice apparatus according to claim 10, wherein said support assembly is supported on an adjustable base stand assembly whereby the height of said support means may be selectively varied.

12. Practice apparatus according to claim 11, wherein said crank arm assembly is pivotally connected to said mounting means whereby said crank arm assembly may be selectively pivoted about a horizontal axis transverse to said golf stroke swing axis and wherein said transverse horizontal axis intersects said golf stroke swing axis at a position substantially coincident with the point of intersection of said golf stroke swing axis with the lower spine of a user.

13. Practice apparatus for positioning a user in a golf stance and for guiding the user's body through a golf stroke, said practice apparatus comprising:

support means supporting an elevated crank arm assembly for pivotal movement about a golf stroke swing axis (19) located by said support means to pass through the upper body, neck and head of a user in a golf swing stance and substantially within the plane of symmetry of the user's upper body;

said crank arm assembly having an offset portion spaced above said swing axis and a hand guide mounting portion which extends forwardly beyond the head position of a user and downwardly beyond said gold stroke swing axis;

a gimbal mounting on said hand guide mounting portion spaced downwaredly from said golf stroke swing axis;

a hand guide assembly connected pivotally to said gimbal mounting and extending downwardly therefrom to guide a player's hand for movement in a selected motion about said golf stroke swing axis;

a mounting axle supported on said offset portion coaxially with a shoulder guide pivot axis (28) which intersects and is inclined to said swing axis;

a shoulder guide mounted on said mounting axle for pivotal movement relative to said offset portion about said shoulder guide pivot axis; and said shoulder guide extending beneath said offset portion for engagement with the shoulders of a user disposed in a golf swing stance.

14. Practice apparatus according to claim 13, wherein said gimbal mounting pivots about a substantially horizontal arm pivot axis (111) which passes through the intersection point between said golf stroke pivot axis and said shoulder guide pivot axis.

* * * * *